US005632850A

United States Patent [19]

Knorr et al.

[11] Patent Number: 5,632,850

[45] Date of Patent: May 27, 1997

[54] MACHINE FOR THE MANUFACTURE OF A WEB OF AT LEAST SINGLE-FACE CORRUGATED BOARD

[75] Inventors: Andreas Knorr, Nürnberg; Hans Mosburger, Weiherhammer; Gustav A. Gnan, Vilseck, all of Germany

[73] Assignee: BHS Corrugated Maschinen- und Anlagenbau GmbH, Weiherhammer, Germany

[21] Appl. No.: 491,215

[22] Filed: Jun. 16, 1995

[30] Foreign Application Priority Data

Jun. 16, 1994 [DE] Germany ..... 44 20 726.3

[51] Int. Cl.[6] ..... B31F 1/28

[52] U.S. Cl. ..... 156/472; 100/153; 156/210

[58] Field of Search ..... 156/472, 473, 156/583.5, 583.3, 210; 100/162 B, 151, 153, 154, 156, 212

[56] References Cited

U.S. PATENT DOCUMENTS

| | | | |
|---|---|---|---|
| 2,638,962 | 5/1953 | Nitchie | 156/473 |
| 3,043,211 | 7/1962 | Appenzeller | 100/162 B |
| 4,531,996 | 7/1985 | Sukenik | 156/472 |
| 4,625,637 | 12/1986 | Pav et al. | 100/162 B |
| 4,992,133 | 2/1991 | Border | 156/583.5 |
| 5,449,431 | 9/1995 | Isowa | 156/473 |
| 5,456,783 | 10/1995 | Sissons | 156/210 |
| 5,466,329 | 11/1995 | Marschke | 156/583.3 |

FOREIGN PATENT DOCUMENTS

| | | |
|---|---|---|
| 0024817 | 3/1981 | European Pat. Off. . |
| 0038237 | 10/1981 | European Pat. Off. . |
| 0104372 | 4/1984 | European Pat. Off. . |
| 0492310 | 7/1992 | European Pat. Off. . |
| 0559181 | 9/1993 | European Pat. Off. . |
| 3831924 | 3/1990 | Germany . |

*Primary Examiner*—Michele K. Yoder
*Attorney, Agent, or Firm*—Browdy and Neimark

[57] ABSTRACT

A machine for the manufacture of a single-face corrugated board web comprises a pressing device for pressing a liner web against a paper web provided with a corrugation. This pressing device has a pressing belt, of which the tension over its width is individually adjustable in that it is guided along a plurality of tensioning devices which are independent of each other and arranged one beside the other.

20 Claims, 4 Drawing Sheets

MACHINE FOR THE MANUFACTURE OF A WEB OF AT LEAST SINGLE-FACE CORRUGATED BOARD

BACKGROUND OF THE INVENTION

1. Field of the Invention

The invention relates to a machine for the manufacture of an at least single-face corrugated board web comprising two fluted rolls for producing a corrugation on a paper web, a gluing device for applying glue to the peaks of the corrugation of the corrugated paper web, a pressing device for pressing a liner web on the glued peaks of the corrugated paper web, which rests on one of the fluted rolls along a pressing zone, the pressing device having an endless pressing belt, which is guided via a deflection pulley and a further pulley and which is pressed against the fluted roll along the pressing zone, and the pressing device having a tensioning device for the pressing belt.

2. Background Art

A machine of the generic type is known from EP 0 492 310 A1. The webs of corrugated board made by machines of this type have a width in the range of between 1.2 and 2.8 m, usually 2.5 m. However, because the deflection pulley tends to bend, there are considerable difficulties in obtaining uniform pressing by the belt over the entire width of the paper web. Therefore, EP 0 492 310 A1 provides for a crowned design of the deflection pulley so as to compensate for the bending of the deflection pulley. The requirements are considerable. In addition, the pressing belt is subject to torsional effects. Further, it is extraordinarily time-consuming and expensive to replace a damaged belt. At least one deflection pulley is supported in bearings, which are each slidable by means of a tensioning drive formed by a piston-cylinder drive.

EP 0 104 372 B1 teaches having a belt pressed against the corrugated roll in the zone of pressing by means of a pad of compressed air.

It is known from U.S. Pat. No. 2,638,962 to guide an endless pressing belt via two deflection pulleys, which are lodged in a link-type frame. The pressure exercised can be modified by adjusting this link-type frame.

It is known from EP 0 024 817 B1, in the zone of pressing, to press an endless belt from its inside against the fluted roll by means of a pressing element.

DE 38 31 924 A1 teaches a roll, in particular a counter-pressure roll of a pair of rolls for the conveyance and/or processing of a web of material to have a stationary roll support and a movable roll sleeve. At least one roll pipe enclosing the roll support is disposed between the roll support and the roll sleeve. This roll pipe is articulated to the roll support for defined motion. The roll sleeve is rotatably supported on it. This design ensures that the counter-pressure roll no longer needs any external pivot levers.

SUMMARY OF THE INVENTION

It is an object of the invention to improve a machine of the generic type such that the pressing of the liner web in the zone of pressing takes place in a particularly simple and reliable way.

According to the invention, this object is solved by the pressing device having a plurality of tensioning devices over the entire width of the pressing belt. The measures according to the invention ensure that the pressing belt can be guided accurately in a simple way. The belt can be tensioned variably over its width, as desired for the distribution of the pressure forces or force over the width of the web of corrugated board. The tensioning devices can in particular take the form of a crowned tensioning pulley, thus ensuring good guidance of the pressing belt. In particular, varying elongations of the pressing belt caused by differences in heating can be compensated.

Further features, advantages and details of the invention will become apparent from the ensuing description of an exemplary embodiment of the invention.

DESCRIPTION OF THE PREFERRED EMBODIMENT

Figure 1:
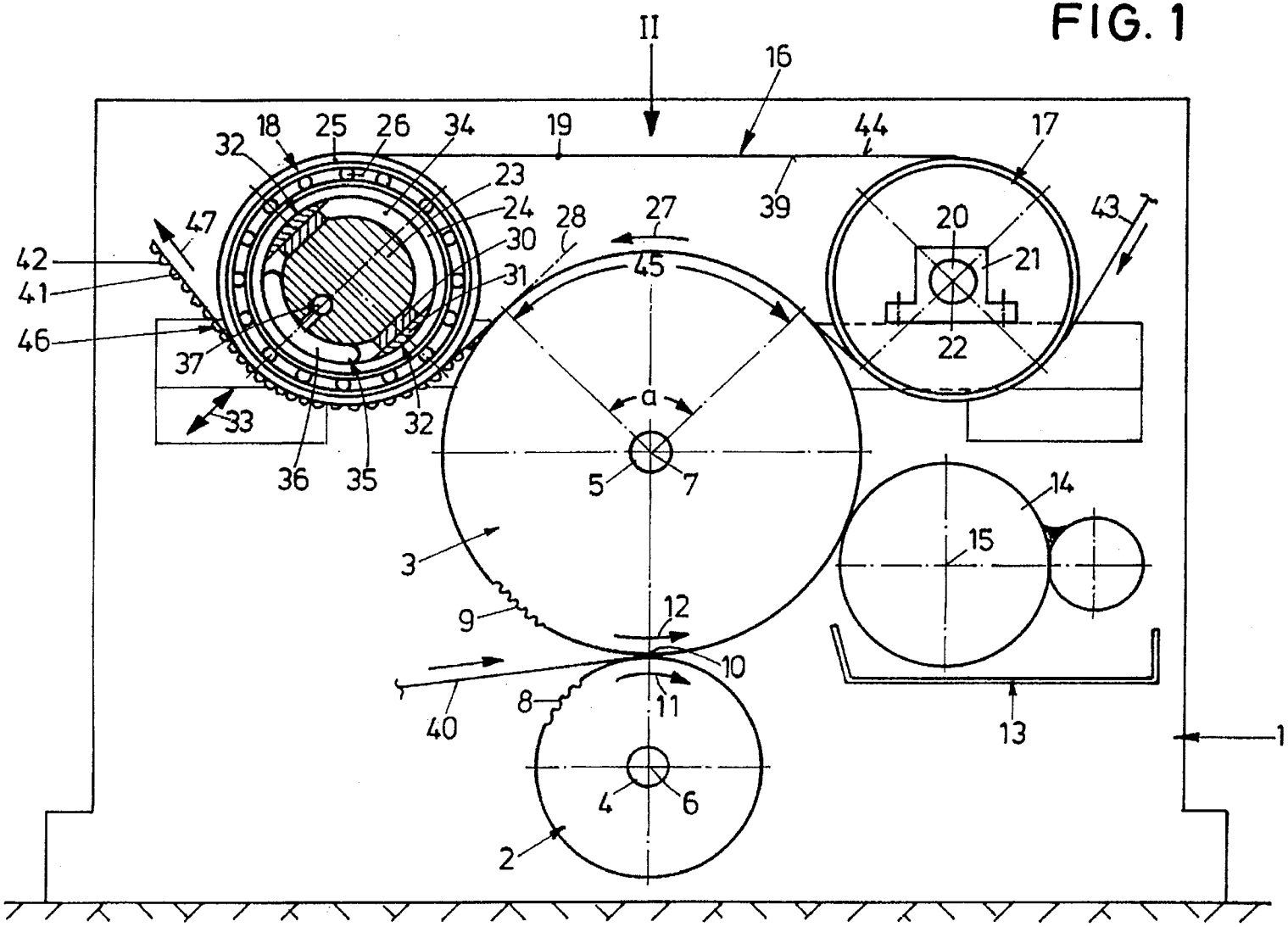
FIG. 1 is a vertical illustration, partially broken up, of a machine for the manufacture of a single-face corrugated board web.

On a machine frame 1, a lower fluted roll 2 and an upper fluted roll 3 are supported for rotation by means of shafts 4,5. They have axes 6, 7 parallel to each other. On their cylinder faces, they are provided with flutings 8, 9, which extend in parallel to the axes 6, 7 and which mesh in the contact area 10 of the two fluted rolls 2, 3. One of the fluted rolls 2, 3, usually the upper fluted roll 3, is driven in the direction of rotation 12, whereas the other fluted roll, usually the lower fluted roll 2, is driven by the other fluted roll 3 in the direction of rotation 11. A gluing device 13 is disposed on the machine frame 1 downstream of the contact area 10 seen in the direction of rotation 11 or 12; this gluing device 13 has a glue spreading roll 14 to be advanced toward the fluting 9 of the upper fluted roll 3. The spreading roll 15 is rotatable about an axis 15.

In the upper part of the upper fluted roll, a pressing device 16 is provided, comprising a deflection pulley 17, a tensioning pulley 18 and a pressing belt 19.

The deflection pulley 17 is supported in bearings 21 of the machine frame 1 for rotation about an axis 22 by means of shaft journals 20 and is driven by the upper fluted roll 3.

The tensioning roll 18 comprises a cylindrical pulley carrier 23 supported stationarily and non-rotatably on the machine frame 1 and on which several supporting rings 24 are disposed one beside the other and non-rotatably relative to the pulley carrier 23. On each supporting ring 24, a shell ring 25 is supported freely rotatably, to which end it is supported on the respective supporting ring 24 by means of a sleeve or ball and roller bearing 26. The pressing belt 19 is guided via the shell rings 25.

As seen in FIG. 1, the pressing belt 19 rests on the fluting 9 of the upper fluted roll 3 by an angle of belt contact a of about 90° and runs in the same direction of rotation as the latter according to the direction arrow 27. The pressing belt 19 runs off the upper fluted roll 3 corresponding to the run-off tangent 28, which is identical with the run-on tangent of the pressing belt 19 toward the tensioning pulley 18.

The supporting rings 24, and the shell rings 25 along with them, are individually displaceable on the pulley carrier 23 parallel to the run-off tangent 28 of the pressing belt 19. To this end, bearing rails 30 are disposed on the pulley carrier 23 in parallel to the latter's axis 29 (see FIG. 2), guide rails 31 being disposed on the inside of each supporting ring 24 and bearing against these bearing rails 30. In this way, slide bearings 32 are formed, by means of which each shell ring 25 is non-displaceable on the pulley carrier 23 at right angles to the run-off tangent 28, and displaceable in the direction 33 substantially free from play and parallel to the run-off tangent 28.

In the space 34 between each supporting ring 24 and the pulley carrier 23, a tensioning drive 35 is arranged, which may for instance be a pressure pad 36 connected with a pressure medium source (not shown) by way of a pressure medium channel 37 provided in the pulley carrier 23. The pressure pad 36 or the pressure pads 36 of each supporting ring 24, respectively, have their individual pressure medium channel 37 assigned to them in the pulley carrier 23, which can be acted upon by a pressure medium independently of the other pressure medium channels 37. As a rule, the pressure medium will be compressed air. As seen in FIG. 1, the tensioning drive 35, upon actuation by a pressure medium, displaces the supporting ring 24 in the direction 33. As a result of the design specified, each shell ring 25 forms a special tensioning pulley for the pressing belt 19, so that the pressing belt 19 can be tensioned variably over its width.

Figure 2:
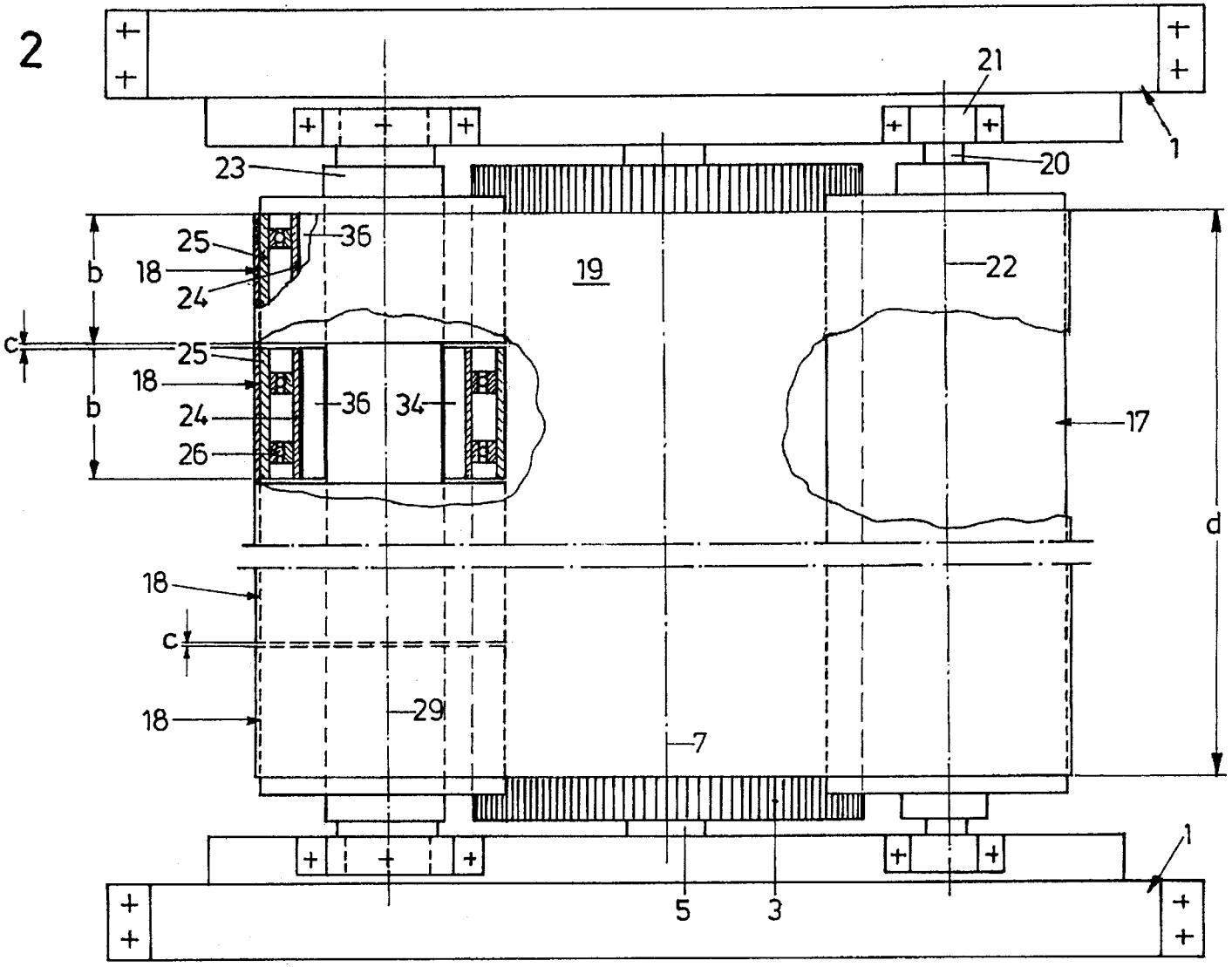
FIG. 2 is a plan view on the machine according to FIG. 1 according to the arrow II of FIG. 1.

As seen in FIG. 2, usually, the width b of the individual shell rings 25 does not exceed 400 mm and as a rule it is in the range of 100 mm to 400 mm. The distance c between adjacent shell rings 25 is as little as possible constructionally, as a rule it will not exceed 10 mm. As a rule, the total width d of the pressing belt 19, and thus of the tensioning pulley 18, is 1.2 to 2.8 m, usually 2.5 m.

Figure 3:
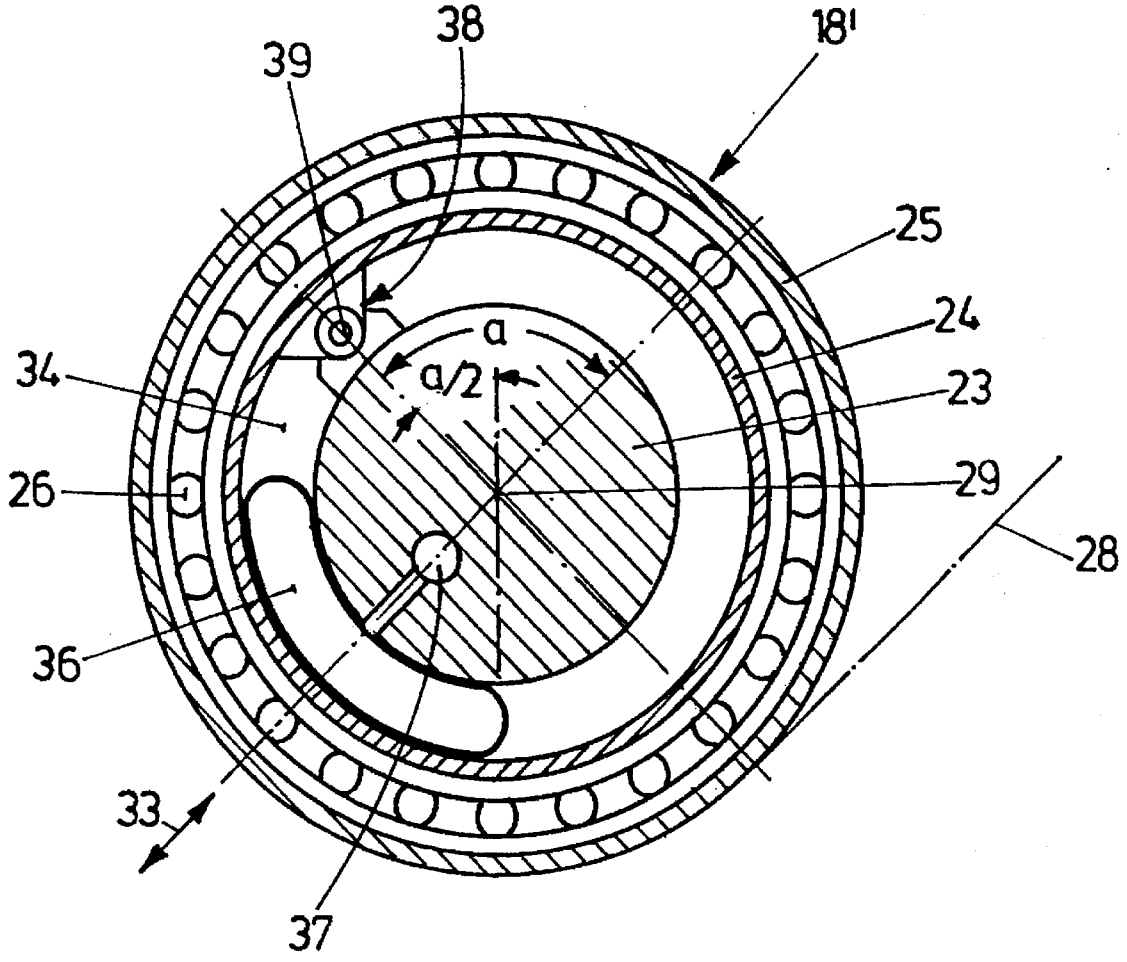
FIG. 3 is a cross-section through a tensioning pulley in a modified embodiment.

The tensioning pulley 18', which is shown in cross-section in FIG. 3, differs from the tensioning pulley 18 of FIGS. 1 and 2 by the way in which the supporting rings 24 are supported or lodged on the pulley carrier 23. In this configuration, the supporting rings 24 are not supported to be displaceable on the pulley carrier 23 by means of slide bearings; rather, the supporting rings 24 are each disposed on the pulley carrier 23 by means of a joint 38, the pivot axis 39 of which extends parallel to the axis 29 of the pulley carrier 23. The joint 38 with its pivot axis 39 is disposed pivoted by an angle a/2 in relation to the vertical, in the present case by 45° in relation to the vertical, so that the supporting rings 24 and the shell rings 25 are pivoted almost precisely in the direction 33 for the minor pivotings occurring. In this case, too, the movement of the supporting rings 24 with the shell rings 25 takes place parallel to the run-off tangent 28.

All the axes 6, 7, 15, 22, 29, 39 extend parallel to each other.

The function of the apparatus is as follows:

A paper web 40 arrives at the area of contact 10 between the lower and the upper fluted roll 2, 3 and is provided with a corrugation 41 by the flutings 8, 9. The peaks 42 of the respective corrugation 41 are provided with glue in the gluing device 13. The rest of the corrugated paper web 40 is not glued. Via the deflection pulley 17 a liner web 43 is supplied, likewise consisting of paper and having the same width as the paper web 40. Maximally, the width of the paper web 40 is equal to the total width d of the pressing belt 19. This liner web 43 is led in on the outside 44 of the pressing belt 19 and, in the pressing zone 45 defined by the angle of belt contact a, it is pressed by the pressing belt 19 against the peaks 42 of the corrugated paper web 40, located on the fluting 9 of the upper fluted roll 3, and united with this paper web 40. In this case, the smooth outside 44 of the pressing belt 19 presses the liner web 43 against the corrugated paper web 40.

Together with the pressing belt 19, the glued, finished corrugated board web 46 lined on one side with a liner web 43 runs off the upper fluted roll 3 in the direction of the run-off tangent 28 and is guided by the pressing belt 19 partially around the tensioning pulley 18 or 18', from where it is supplied in the draw-off direction 47 toward a take-up unit. The individual shell rings 25 are regulated during operation such that the the belt tension in the pressing belt 19 is constant or has a desired course over the latter's width. Owing to the varying regulation of the shell rings 25 over the width of the pressing belt 19, that portion of the tensioning pulley 18 which is contacted by the pressing belt 19 as illustrated on the left in FIG. 1 can become crowned in shape, as a result of which the pressing belt 19 is guided laterally exactly on the tensioning pulley.

Figure 4:
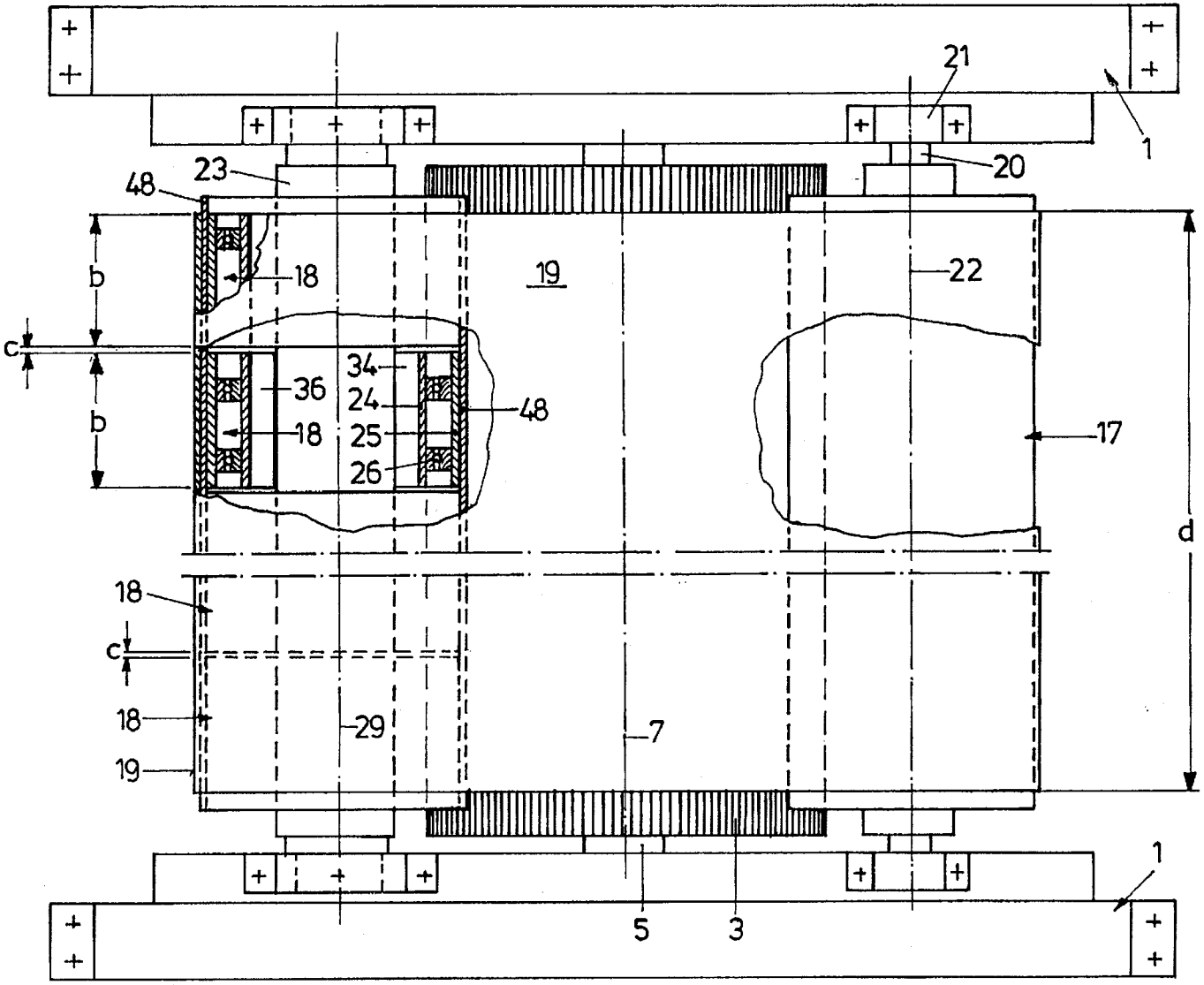
FIG. 4 is a plan view on a modified embodiment of a machine in an illustration corresponding to FIG. 2.

As illustrated in FIG. 4, the effect described above of a crowned design of the tensioning pulley 18 can still be increased in that a continuous, elastically flexible tube 48 consisting of plastics in view of these properties is slipped over the shell rings 25 of all the tensioning pulleys 18. Upon corresponding regulation of the shell rings 25, this tube 48 is deformed over its entire length, taking for instance a crowned shape in the cross-sectional plane shown on the left in FIG. 4, which extends parallel to the run-off tangent 28 and corresponds to the regulating direction 33. Alternately, it can be suitable for the corrugated board web 46 to be drawn off the fluted roll 3 in the direction of the run-off tangent 28 and to be led on straight instead of being guided around the tensioning pulley 18 or 18', in which case it is then led out of the machine via a deflection pulley (not shown). The tube 48 need not necessarily be slipped over the shell rings 25; if required, it can be slipped directly on the sleeve or ball and roller bearings 26, i.e. in this case the shell rings 25 are formed by an elastically flexible one-piece tube of plastics material. It is of decisive importance that the tube 48 be deformable by few millimeters, as a rule not more than 1 mm, over its entire length of up to 2.5 m. In this regard, it may also be a thin steel tube or a slit steel tube.

Suitably, the pressing belt consists of plastics so that it can be tensioned variably over its width.

What is claimed is:

1. A machine for the manufacture of an at least single-face corrugated board web (46) comprising two fluted rolls (2, 3) for producing a corrugation (41) on a paper web (40), a gluing device (13) for applying glue to the peaks (42) of the corrugations (41) of the corrugated paper web (40), a pressing device (16) for pressing a liner web (43) on the glue on the peaks (42) of the corrugated paper web (40), which rests on one of the fluted rolls (3) along a pressing zone (45), the pressing device (16) having an endless pressing belt (19), which is guided via a deflection pulley (17) and a further pulley (18, 18') and which is pressed against the fluted roll (3) along the pressing zone (45), and the pressing device (16) having a plurality of tensioning devices for the pressing belt (19), wherein over the entire width (d) of the pressing belt (19), the pressing device (16) has a plurality of tensioning devices, wherein the pressing belt (19) is guided along a plurality of tensioning pulleys (25), which are movable at right angles to an axis (29) of said tensioning pulleys, wherein the tensioning pulleys (25) are moveably supported on a common stationary pulley carrier (23), wherein the tensioning pulleys (25) are movable out of the pressing zone (45) about in parallel to the run-off direction (28) of the corrugated board web (46), and wherein supporting rings (24) are displaceably supported on the pulley carrier (23), the tensioning pulleys (25) being rotatably supported on the supporting rings (24).

2. A machine according to claim 1, wherein the supporting rings (24) are supported on the pulley carrier (23) by means of slide bearings (32).

3. A machine according to claim 1, wherein a tensioning drive (35) is disposed between the pulley carrier (23) and each supporting ring (24).

4. A machine according to claim 3, wherein the tensioning drive (35) is formed by at least one pressure-medium-actuatable pressure pad (36).

5. A machine according to claim 1, wherein a width b of the tensioning pulleys (25) is <400 mm.

6. A machine according to claim 5, wherein the width b is greater than 100 mm and less than 400 mm.

7. A machine according to claim 1, wherein a distance of the two adjacent tensioning pulleys is <10 mm applies to the distance (c) of two adjacent tensioning pulleys (25).

8. A machine according to claim 1, wherein an elastically flexibly deformable tube (48) enclosing the tensioning devices is disposed between the tensioning devices and the pressing belt (19).

9. A machine according to claim 8, wherein the tube (48) consists of plastics.

10. A machine according to claim 1, wherein the pressing belt (19) consists of plastics.

11. A machine for the manufacture of an at least single-face corrugated board web (46) comprising two fluted rolls (2, 3) for producing a corrugation (41) on a paper web (40), a gluing device (13) for applying glue to the peaks (42) of the corrugations (41) of the corrugated paper web (40), a pressing device (16) for pressing a liner web (43) on the glue on the peaks (42) of the corrugated paper web (40), which rests on one of the fluted rolls (3) along a pressing zone (45), the pressing device (16) having an endless pressing belt (19), which is guided via a deflection pulley (17) and a further pulley (18, 18') and which is pressed against the fluted roll (3) along the pressing zone (45), and the pressing device (16) having a plurality of tensioning devices for the pressing belt (19), wherein over the entire width (d) of the pressing belt (19), the pressing device (16) has a plurality of tensioning devices, wherein the pressing belt (19) is guided along a plurality of tensioning pulleys (25), which are movable at right angles to their axis (29), wherein the tensioning pulleys (25) are movably supported on a common stationary pulley carrier (23), and wherein the tensioning pulleys (25) are movable out of the pressing zone (45) about in parallel to the run-off direction (28) of the corrugated board web (46), wherein on the pulley carrier (23), supporting rings (24) are pivotably lodged, on which the tensioning pulleys (25) are rotatably supported.

12. A machine according to claim 11, wherein supporting rings (24) are displaceably supported on the pulley carrier (23), the tensioning pulleys (25) being rotatably supported on the supporting rings (24).

13. A machine according to claim 11, wherein a tensioning drive (35) is disposed between the pulley carrier (23) and each supporting ring (24).

14. A machine according to clam 13, wherein the tensioning drive (35) is formed by at least one pressure-medium-actuable pressure pad (36).

15. A machine according to claim 11, wherein a width b of the tensioning pulleys (25) is <400 mm.

16. A machine according to claim 11, wherein a distance of two adjacent tensioning pulleys (25) is <10 mm.

17. A machine according to claim 11, wherein an elastically flexibly deformable tube (48) enclosing the tensioning devices is disposed between the tensioning devices and the pressing belt (19).

18. A machine according to claim 17, wherein the tube (48) consists of plastics.

19. A machine according to claim 11, wherein the pressing belt (19) consists of plastics.

20. A machine according to claim 15 wherein the width b is greater than 100 mm and less than 400 mm.

* * * * *